United States Patent [19]

Witczak

[11] Patent Number: 4,553,477

[45] Date of Patent: Nov. 19, 1985

[54] INK FOUNTAIN FOR DUPLICATING MACHINES

[75] Inventor: Stanley Witczak, Chicago, Ill.

[73] Assignee: A.M. Internation, Inc., Chicago, Ill.

[21] Appl. No.: 680,009

[22] Filed: Dec. 10, 1984

Related U.S. Application Data

[63] Continuation of Ser. No. 484,408, Apr. 13, 1983, abandoned.

[51] Int. Cl.[4] ..... B41F 31/04; B41F 31/06; B41L 27/08

[52] U.S. Cl. ..... 101/365

[58] Field of Search ..... 101/363, 364, 350, 148, 101/365, 147, 207, 208, 209, 210

[56] References Cited

U.S. PATENT DOCUMENTS

| | | | |
|---|---|---|---|
| 236,566 | 1/1881 | Engels | 101/210 |
| 907,638 | 12/1908 | Page | 101/210 |
| 1,165,160 | 12/1915 | Dunnet | 101/210 |
| 1,919,283 | 7/1933 | Troy | 101/210 |
| 2,301,535 | 11/1942 | Green | 101/210 |
| 3,135,197 | 6/1964 | Dutro et al. | 101/364 |

FOREIGN PATENT DOCUMENTS

| | | | |
|---|---|---|---|
| 2437584 | 5/1975 | Fed. Rep. of Germany | 101/363 |

*Primary Examiner*—J. Reed Fisher

*Attorney, Agent, or Firm*—Wood, Dalton, Phillips, Mason & Rowe

[57] ABSTRACT

An ink fountain assembly for use in duplicating machines, such as rotary offset lithographic machines. A fountain trough is defined by an elongated blade extending along one side of the trough and an ink fountain roller extending along the other side of the trough. A fixed wall defines one end of the trough for flush abutment against adjacent ends of the blade and the roller to prevent ink leakage therethrough. An adjustable wall defines an opposite end of the fountain trough and is releasably secured against the top of the blade to provide a seal therewith. The adjustable wall is movable relative to the blade to bring the adjustable wall into flush abutment against the opposite end of the ink fountain roller to provide a seal therewith and prevent ink leakage therebetween.

2 Claims, 4 Drawing Figures

INK FOUNTAIN FOR DUPLICATING MACHINES

This application is a continuation of application Ser. No. 484,408, filed Apr. 13, 1983, now abandoned.

BACKGROUND OF THE INVENTION

This invention relates generally to duplicating machines and, more particularly, to ink fountain assemblies for use in duplicating machines.

Printing machines, such as rotary offset lithographic duplicating machines, normally include a printing couple which comprises a number of cylinders and/or rollers such as impression cylinders, master cylinders, blanket cylinders, ductor rollers, regulator rollers, and the like. An ink fountain is disposed at the rear end of the machine for feeding ink to the various rollers of the printing couple which transfers images to copy sheets.

Conventional ink fountain assemblies normally take the form of a fountain trough defined by an elongated blade extending along one side and an ink fountain roller extending along the opposite side of the trough. The ink fountain roller transfers the ink to the other rollers of the printing couple. The blade is adjustable by a plurality of thumb screws to vary the gap between an edge of the blade and the ink fountain roller in order to maintain consistency in the amount of ink applied to the roller uniformly along the length of the roller. The adjustable blade and ink fountain roller are mounted on brace assemblies at the rear end of the duplicating machine and permit ready removal and/or replacement of the fountain.

One of the problems with ink fountain assemblies of the character described is leakage of the ink between the ends of the adjustable blade and the ink fountain and between the ends of the roller and the ink fountain. Although ink used in printing machines, such as rotary offset lithographic duplicating machines, is a rather viscous liquid, leakage continues to be a dominant problem.

Heretofore, the problem of leakage has been combated by attempts to maintain very close tolerances and precise fit between the adjustable blade, the ink fountain roller and the ink fountain. However, even close tolerances of these various parts of the ink fountain assembly have not completely solved the leakage problem.

There is a need for an improved ink fountain assembly for use in duplicating machines to substantially eliminate the problem of leakage from the fountain trough. This invention is directed to satisfying that need and overcoming the problems outlined above.

SUMMARY OF THE INVENTION

An object, therefore, of the invention is to provide a new and improved ink fountain assembly for supplying ink to the printing couple of a duplicating machine.

Another object of the invention is to provide an ink fountain assembly which is substantially leak-proof when used with viscous-type ink in printing machines, such as rotary offset lithographic duplicating machines.

In the exemplary embodiment of the invention, an ink fountain assembly for use in duplicating machines includes a fountain trough defined by an elongated blade extending along one side of the trough and an ink fountain roller extending along the other side of the trough. Fixed wall means define one end of the fountain trough for flush abutment against adjacent ends of the blade and the fountain roller to form a seal therewith and to prevent ink leakage therebetween. Adjustable wall means define an opposite end of the fountain trough. The adjustable wall means are secured to the blade to prevent ink leakage therebetween. The adjustable wall means are adjustable relative to the blade to bring the adjustable wall means into flush abutment against the opposite end of the fountain roller to provide a seal therewith and to prevent ink leakage therebetween.

The adjustable wall means include flat surface means for securing against the top surface of the blade to form a seal therewith. Releasable fastening means, such as elongated bolts, secure the adjustable wall means to the blade. The bolts extend through enlarged bores in the adjustable wall means whereby the enlargement of the bores provide the degree of adjustment necessary for the adjustable wall means.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
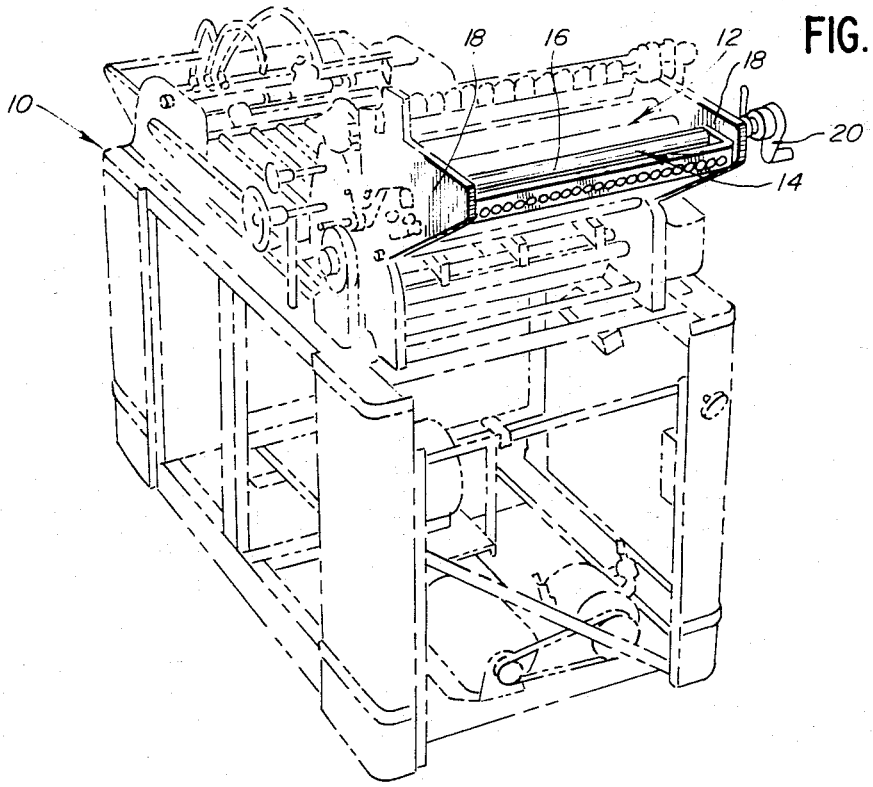
FIG. 1 is a perspective view of a rotary offset lithographic machine, shown in phantom, incorporating an ink fountain assembly at the top, rear of the machine.

Referring to the drawings in greater detail, and first to FIG. 1, a conventional rotary offset lithographic duplicating machine is shown in phantom and generally designated 10. The machine has a standard printing couple, generally designated 12, which includes conventional cylinders and rollers for feeding ink through the couple and transferring images to copy sheets. An ink fountain assembly, generally designated 14, is disposed at the head of the printing couple and includes an ink fountain roller 16 disposed between a pair of side braces 18. A crank 20 is provided for manually rotating fountain roller 16 independently of automatic rotation of the fountain roller during operation of the machine.

Figure 2:
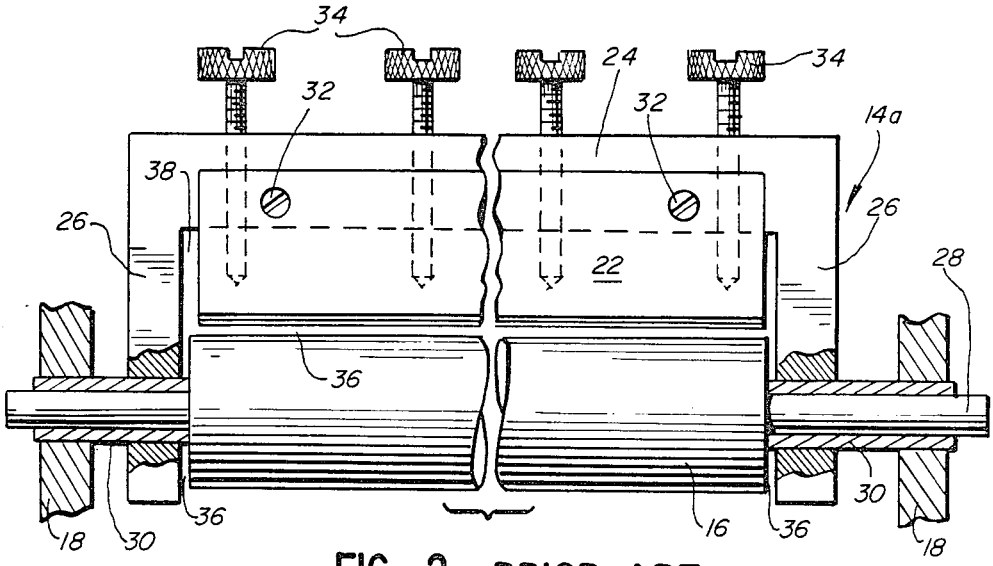
FIG. 2 PRIOR ART
FIG. 2 is a fragmented top plan view of an ink fountain assembly of the prior art.

FIG. 2 shows an ink fountain assembly, generally designated 14A, of the prior art. As stated above, a conventional ink fountain assembly includes a fountain trough defined by an elongated blade 22 extending along one side of the trough and ink fountain roller 16 extending along the other side of the trough. The blade and roller are mounted on a frame 24 which includes a pair of side plate portions 26 defining opposite ends of the fountain trough. Roller 16 is fixed to an axle 28 which is journalled at opposite ends in bushings 30 which extend through side plates 26 and side braces 18. Blade 22 is secured to frame 24 by a plurality of threaded fasteners 32. As is known, a plurality of thumb screws 34 are threaded through frame 24 whereby the distal ends of the screws angularly abut against the underside of blade 22. By adjusting the thumb screws, a gap 36 between blade 22 and roller 16 can be varied along the length of the roller to maintain a consistent thickness of ink applied to the roller uniformly along the blade.

A problem with ink fountain assemblies 14A of the prior art is the tendency of ink to leak through the fountain trough and onto other adjacent components of the duplicating machine. The most prevalent areas of leakage is at the ends of blade 22 and the ends of ink fountain roller 16. More particularly, FIG. 2 shows gaps 36 between the ends of roller 16 and side plates 26 and gaps 38 between the ends of blade 22 and the side plates. These gaps are exaggerated in the drawing for illustration purposes. In order to overcome the problem of leakage, attempts have been made to maintain close tolerances between the components of the ink fountain assembly, particularly between the roller, the blade and the side plates of frame 24. Not only is it expensive to fabricate components with such close tolerances, but such attempts simply have not been completely successful in practice and leakage still occurs.

Figure 3:
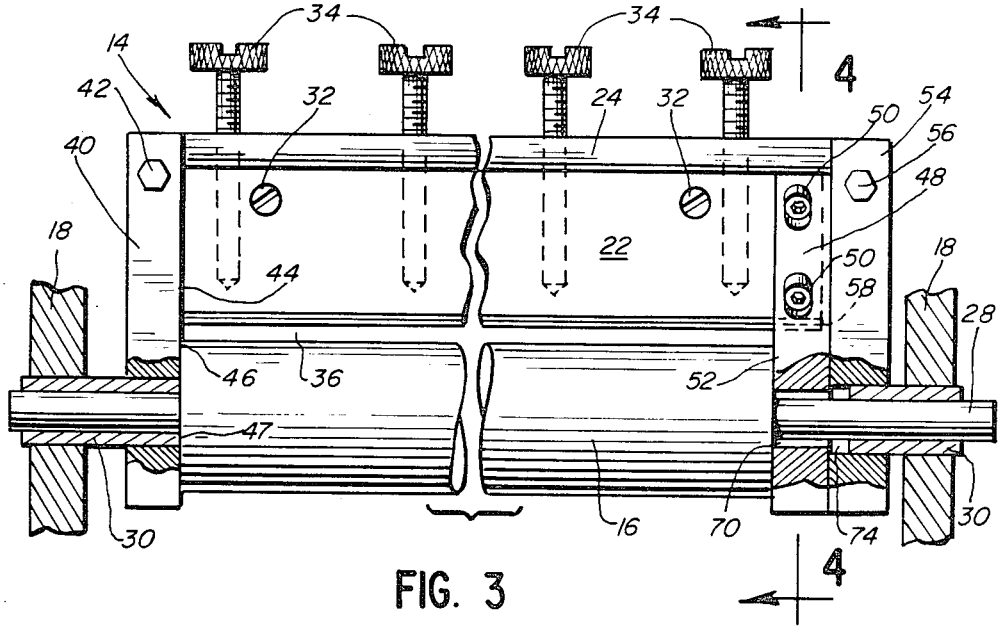
FIG. 3 is a fragmented top plan view of the ink fountain assembly of the invention.

Referring to FIG. 3, ink fountain assembly 14 of the invention is designed to overcome the problem of ink leakage. Like numerals have been applied to FIGS. 3 and 4 where appropriate to indicate like components described in relation to FIG. 2.

More particularly, ink fountain assembly 14 includes a fountain trough defined by blade 22 and ink fountain roller 16. As described above, roller 16 includes an axle 28 journalled in bushings 30 extending through side braces 18. The blade is mounted on frame 24 by threaded fasteners 32. Thumb screws 34 are provided for adjusting gap 36 between the blade and the roller as described above.

The invention contemplates a fixed wall 40 defining one end of the fountain trough, the left-hand end in FIG. 3. The fixed wall is secured to frame 24 by a fastener 42. Blade 22 is secured by threaded fastener 32 to frame 24 for flush abutment with fixed wall 40, as at 44, to provide a seal to prevent ink leakage between the blade and the fixed wall. It can be seen that ink fountain roller 16 is disposed in flush abutment, as at 46, against fixed wall 40 to prevent ink leakage between the roller and the fixed wall. It also can be seen that bushing 30 is disposed in flush abutment, as at 47, against ink fountain roller 16.

The opposite end of the fountain trough is defined by an adjustable wall 48 which is secured to blade 22 by a pair of threaded bolts 50. Adjustable wall 48 is secured directly onto the top of the blade to form a seal therewith and prevent ink leakage between the blade and the adjustable wall. As will be described hereinafter, the adjustable wall can be brought into flush abutment, as at 52, against the right-hand end of roller 16 to form a seal therewith and prevent ink leakage between the roller and the adjustable wall.

A right-hand side plate 54 is secured by a fastener 56 to frame 24 and also is adjustable relative to the frame to provide abutting support against the outside of adjustable wall 48. To this end, it can be seen that there is a gap 58 between the adjacent end of blade 22 and side plate 54.

Figure 4:
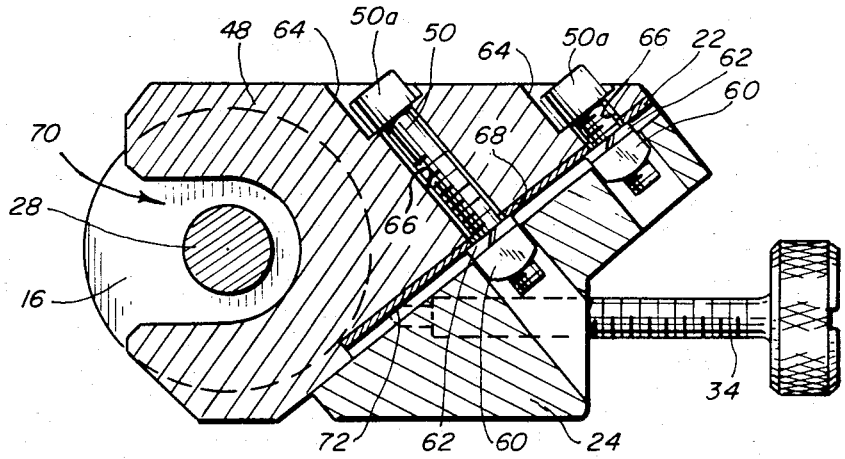
FIG. 4 is a vertical section, on an enlarged scale, taken generally along line 4—4 of FIG. 3.

Referring to FIG. 4, it can be seen that bolts 50 extend through adjustable wall 48 and blade 22 and secure the adjustable wall to the top of the blade by means of nuts 60 and washers 62 on the underside of the blade. The bolts have enlarged heads 50*a* received in countersunk recesses 64 in adjustable wall 48. Thus, the recesses form abutment shoulders with the underside of bolt heads 50*a* to securely clamp adjustable wall 48 to blade 22 in a releasable manner.

Releasable bolts 50 extend through enlarged bores 66 in adjustable wall 48. This enlargement of the bores provides the necessary degree of adjustment of adjustable wall 48. In practice, 0.015 inch clearance between the bolts and the bores has proven satisfactory to accommodate any manufacturing tolerances expected with fabricating ink fountain roller 16.

It can be seen from the above description that a new and improved ink fountain assembly has been provided wherein the components of the assembly provide a substantially leak-proof arrangement. In particular, blade 22 is mounted directly on frame 24 by threaded fasteners 32 in flush abutment with fixed wall 40 to provide a seal therewith, as at 44. Ink fountain roller 16 is positioned in the assembly in flush abutment with fixed wall 40 to provide a seal therewith, as at 46. Bolts 50 are loosened to free or release adjustable wall 48 for movement into flush engagement with the opposite end of the roller (the right-hand end as viewed in FIG. 3) to provide a seal with the roller, as at 52. The bolts then are tightened to bring a flat undersurface 68 (FIG. 4) into tight engagement with the top of blade 22 and form a seal with the blade. Fastener 56 then is released and side plate 54 finally is brought into backing support for adjustable wall 48 whereupon fastener 56 is tightened within an appropriate enlarged bore to fix the side plate in position. During operation, thumb screws 34 are adjusted along blade 22 to maintain a uniform gap 36 between the blade and the roller. Adjustable side wall 48 accordingly is moved between the face of fixed wall 54 and the face of ink fountain roller 16 into flush abutment therewith. An aperture 70 in adjustable plate 48 is larger in diameter than axle 28 of ink fountain roller 16. This enlarged aperture accommodates radial movement of adjustable wall 48, because the adjustable wall moves with blade 22 during adjustment by thumb screws 34. FIG. 4 shows the distal end of one thumb screw 34 engaging the underside of blade 22, as at 72. In addition, it can be seen in FIG. 3 that a gap 74 is provided between adjustable side wall 48 and the inner end of bushing 30. The bushing is fixed to side brace 18 and gap 74 allows for axial movement of adjustable plate 48 and side plate 54 without interference by the inner end of the bushing.

The ink fountain assembly of the present invention can be seen to be very simple to fabricate and adjust. A substantially leak-proof assembly is provided and the expensive maintenance of tolerances as is prevalent in the prior art has been substantially eliminated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An ink fountain assembly for use in duplicating machines, such as rotary offset lithographic machines, including a fountain trough defined by an elongated blade and an ink fountain roller, the roller having flat end faces, comprising:

fixed wall means defining one end of the fountain trough for flush abutment against the adjacent end of the blade and the respective flat end face of the fountain roller to prevent ink leakage therebetween; and adjustable wall means defining and opposite end of the fountain trough, the adjustable wall means having flat surface means on the underside thereof for securing against the top surface of the blade to prevent ink leakage therebetween, and releasable fastening means for securing said adjustable wall means against the top surface of the blade whereby the wall means is adjustable relative to the blade and axially of the fountain roller to bring the adjustable wall means into flush abutment against the opposite flat end face of the ink fountain roller to prevent ink leakage therebetween.

2. The ink fountain assembly of claim 1, wherein said releasable fastening means includes at least one elongated fastener extending through an enlarged bore in the adjustable wall means, the enlargement of the bore providing the degree of adjustment of the adjustable wall means.

* * * * *

UNITED STATES PATENT AND TRADEMARK OFFICE

CERTIFICATE OF CORRECTION

PATENT NO. : 4,553,477

DATED : November 19, 1985

INVENTOR(S) : Stanley Witczak

It is certified that error appears in the above-identified patent and that said Letters Patent is hereby corrected as shown below:

Title page:

The name of the Assignee should be changed to read "A.M. International, Inc., Chicago, Ill."

Column 5, line 6, Claim 1, delete "and" and substitute therefor --an--.

Signed and Sealed this

*Eleventh* Day of *February 1986*

[SEAL]

*Attest:*

DONALD J. QUIGG

*Attesting Officer*

*Commissioner of Patents and Trademarks*